United States Patent [19]

Backlund

[11] 4,057,057

[45] Nov. 8, 1977

[54] BREATHING MASK, ESPECIALLY A HALF MASK OR A FULL MASK PROVIDED WITH AN INNER MASK

[75] Inventor: Sigurd Alfons Backlund, Vaasa, Finland

[73] Assignee: Kemira Oy, Finland

[21] Appl. No.: 615,822

[22] Filed: Sept. 22, 1975

[30] Foreign Application Priority Data

Oct. 8, 1974 Finland ..... 742934

[51] Int. Cl.[2] ..... A62B 7/00

[52] U.S. Cl. ..... 128/142.4

[58] Field of Search ..... 128/141 R, 142.4–142.7, 128/145 A, 146–146.7

[56] References Cited

U.S. PATENT DOCUMENTS

| | | | |
|---|---|---|---|
| 2,905,172 | 9/1959 | Rodenhouse | 128/141 R |
| 2,951,418 | 9/1960 | Bitner et al. | 128/142.4 |

FOREIGN PATENT DOCUMENTS

| | | | |
|---|---|---|---|
| 859,715 | 9/1940 | France | 128/142.7 |
| 829,792 | 4/1938 | France | 128/142.4 |
| 2,029,461 | 12/1971 | Germany | 128/142.4 |

*Primary Examiner*—Robert W. Michell
*Assistant Examiner*—Henry J. Recla
*Attorney, Agent, or Firm*—Bucknam and Archer

[57] ABSTRACT

A gas mask, especially a half mask or a full mask provided with an inner mask, and having protective glasses or spectacles and means for attaching them to the half mask or directly to the inner mask.

4 Claims, 2 Drawing Figures

BREATHING MASK, ESPECIALLY A HALF MASK OR A FULL MASK PROVIDED WITH AN INNER MASK

BACKGROUND OF THE INVENTION

The present invention relates to a gas mask, especially a half mask or a full mask provided with an inner mask.

When using spectacles together with full masks of a known construction, the spectacles have so far been attached either directly or indirectly to the outer mask. One example is U.S. Pat. No. 2,671,445, in which the spectacle frame is hinged on the outside to the outer mask. Spectacles so attached cannot be positioned correctly in relation to the eyes since faces of different shapes and sizes are positioned differently in relation to the mask and its eye opening. Swedish Pat. No. 89 352 describes a solution according to which the spectacles are attached to the outer mask at three points. According to this patent the adjustment of the spectacles is very difficult and complicated because the spectacles have to be positioned by means of three attachments. Other known ways of attaching spectacles are also complicated. Normal spectacle bows cannot be used in full masks since they lessen the tightness of the mask. Using spectacles with bows together with a half mask in uncomfortable and inconvenient if a helmet and/or a hearing protector are also used at the same time.

U.S. Pat. No. 2,951,418 describes a full mask in which the spectacles are attached to the full mask by means of an attaching member hinged inside it, one end of the member being hinged to the spectacle frame and the other end being pushed into an opening in the full mask. In addition, from U.S. Pat. No. 2,905,172 a full mask is known, and the spectacles are attached inside it by means of a relatively stiff but bendable arm, one end of which has been attached inside the full mask and to the other end of which the spectacle frame has been attached so that it can be slid. Each attaching mechanism is relatively complicated and expensive, and in each case the spectacles are attached to the full mask.

The object of the present invention is to eliminate the above drawbacks and to provide a gas mask, especially a half mask or a full mask provided with an inner mask.

SUMMARY OF THE INVENTION

According to the invention the protective glasses or spectacles are now attached directly to the inner mask which fits snugly to the wearer's face. This ensures correct position of the glasses in relation to the wearer's eyes as the inner mask will always be in the same position due to the snug fitting around the wearer's nose. Accordingly the glasses, once adjusted, will always be correctly positioned when the inner mask is placed on the same wearer's face. The same applies for a half mask provided with a glass support structure attached to the half mask in accordance with the invention.

The half mask and the inner mask of the full mask are similarly constructed rubber parts. In both, the rubber part covers the mouth and the nose. According to the invention, the spectacles are attached by means of a strip or pin soldered to the spectacle frame so that the strip or pin is pushed into an opening situated in a protuberance on the rubber part surface at the nose arch. The pressing force of the rubber keeps the strip or pin firmly attached to the mask. According to the invention, there can also be several attaching strips or pins and respectively several attaching openings.

According to the invention, in the full mask the spectacles are attached to the inner mask and not to the outer mask as in all known attaching methods. Also novel is the simplicity of the attaching, by which a sturdier and more comfortable attachment and an easier positioning of the spectacles are obtained than in previously known methods.

The attachment according to the invention also provides advantages in production techniques and in the standardization of the products. According to the invention, a small protuberance and an opening in it are made in the inner mask at the nose. This can be provided already in the mold for the rubber part, in which case it is possible, when necessary, to use the spectacles according to the invention in all full masks produced.

The attachment according to the invention can also be applied to the attaching of protective glasses in a half mask.

DESCRIPTION OF THE PREFERRED EMBODIMENTS

Figure 1:
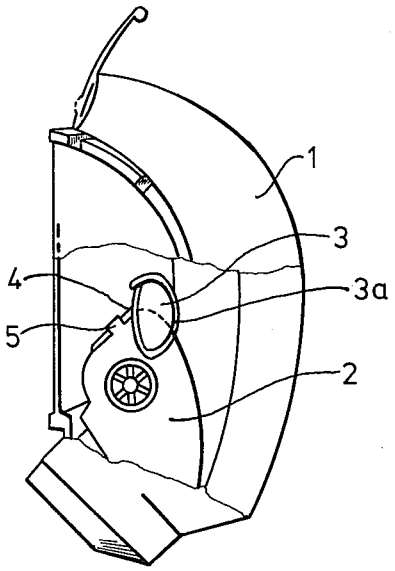
FIG. 1 depicts a partially cut side view of a full mask provided with an inner mask according to the invention.

In the mask according to FIG. 1, the outer mask is indicated by 1 and the inner mask by 2. The frame 3*a* of the spectacles 3 has been provided with an attaching element 4 which protrudes from it in the direction of the nose. In the device illustrated in the example, this element is a pin which can be pushed into a sleeve, opening, groove or the like in the inner mask 2. When the pin 4 is made from a relatively stiff material which, however, bends somewhat, the position of the spectacles can be easily adjusted by pushing the pin 4 into different depths in the sleeve 5 and by thereafter bending the pin e as needed. In this manner the height and the distance of the spectacles in relation to the eyes can be adjusted to suit the wearer.

Figure 2:
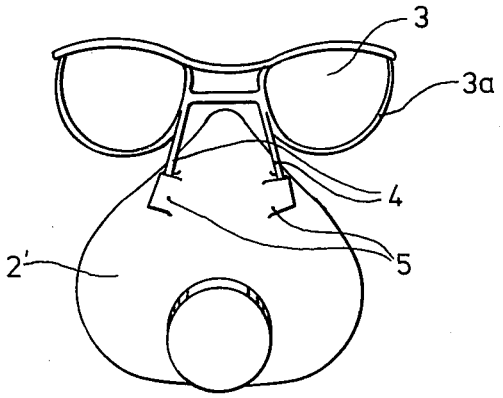
FIG. 2 depicts a front view of a half mask provided with spectacles, according to the invention.

There can also be several attaching elements 4, for example two, as in the half mask shown in FIG. 2. Since the spectacles or protective glasses are in this case outside the mask, it is more secure to attach them with two pins, the respective sleeves, openings or grooves being situated at suitable points in the mask.

Owing to the invention, the spectacles or protective glasses can be attached to breathing masks so that the glasses can be adjusted according to the needs of the wearer, and the frames, hinges and other complex attaching members complicated to use are eliminated.

In FIG. 2, the spectacles 3 have been attached by means of pins 4 to openings in protuberances 5 on both sides of the center line of the half mask 2' so that the pins 4 can be pushed into the openings to the desired depth. The openings are tight enough for the pins to remain securely in them.

What is claimed is:

1. A gas mask of the type comprising an outer mask and a separate inner mask having a nose arch and adapted to cover the nose and mouth of a wearer, comprising: a support structure for glasses and means for attaching the support structure directly to the nose arch of the inner mask in order to obtain correct positioning of the glasses in relation to the wearer's face, and in which the nose arch has at least one opening for receiving the means for attaching the glass support structure to an adjustable depth in order to adjust the vertical position of the glass support structure, said means for attaching the glass support structure being tightly held in said opening.

2. The gas mask of claim 1, in which the opening is a sleeve formed on the inner mask, the attaching means being tightly slidable within it.

3. A gas mask of the type having a nose arch and adapted to snugly cover the nose and mouth of a wearer, comprising: a support structure for glasses and means for attaching the support structure directly to the nose arch in order to obtain correct positioning of the glasses in relation to the wearer's face and wherein the nose arch is formed with at least one opening adapted to receive the means for attaching the support structure to a controlled depth for vertical adjustment of the support structure, said means for attaching the glass support structure being tightly held in said opening.

4. The gas mask of claim 3, in which the opening is a sleeve formed on the nose arch, the means for attaching the support structure being tightly slidable within the sleeve.

* * * * *